US007946755B2

(12) United States Patent
Greubel et al.

(10) Patent No.: US 7,946,755 B2
(45) Date of Patent: May 24, 2011

(54) WATCH MOVEMENT

(75) Inventors: Robert Greubel, Lignieres (CH); Stephen Forsey, Les Brenets (CH)

(73) Assignee: CompliTime SA, La Chaux-de-Fonds (CH)

( * ) Notice: Subject to any disclaimer, the term of this patent is extended or adjusted under 35 U.S.C. 154(b) by 0 days.

(21) Appl. No.: 12/526,413

(22) PCT Filed: Feb. 5, 2008

(86) PCT No.: PCT/EP2008/051407
§ 371 (c)(1),
(2), (4) Date: Aug. 7, 2009

(87) PCT Pub. No.: WO2008/101802
PCT Pub. Date: Aug. 28, 2008

(65) Prior Publication Data

US 2010/0097899 A1 Apr. 22, 2010

(30) Foreign Application Priority Data

Feb. 8, 2007 (EP) ..... 07101958

(51) Int. Cl.
*G04B 15/00* (2006.01)
*G04B 1/10* (2006.01)

(52) U.S. Cl. ..... 368/127; 368/142; 368/318

(58) Field of Classification Search ..... 368/127–133, 368/140, 142, 318
See application file for complete search history.

(56) References Cited

U.S. PATENT DOCUMENTS

| | | | | |
|---|---|---|---|---|
| 7,350,966 | B2 * | 4/2008 | Zaugg | 368/140 |
| 7,445,375 | B2 | 11/2008 | Kasapi | |
| 7,677,793 | B2 * | 3/2010 | Lete et al. | 368/127 |
| 7,697,376 | B2 * | 4/2010 | Ruchonnet | 368/76 |
| 2005/0073913 | A1 * | 4/2005 | Born et al. | 368/127 |
| 2008/0144447 | A1 * | 6/2008 | Ruchonnet et al. | 368/127 |
| 2009/0268565 | A1 * | 10/2009 | Salathe | 368/131 |

FOREIGN PATENT DOCUMENTS

| | | |
|---|---|---|
| CH | 60360 | 7/1913 |
| EP | 1 394 638 | 3/2004 |
| EP | 1 686 435 | 8/2006 |
| WO | 03/017009 | 2/2003 |
| WO | 2005/043257 | 5/2005 |
| WO | 1 564 608 | 8/2005 |

OTHER PUBLICATIONS

International Search Report dated Sep. 2, 2008, from corresponding PCT application.

* cited by examiner

*Primary Examiner* — Sean Kayes
(74) *Attorney, Agent, or Firm* — Young & Thompson

(57) ABSTRACT

A watch movement, includes a frame (10, 11, 20, 22, 24), defined by a first and a second parallel plane surface and defining reference planes (A, B), the second plane (B) being located alongside the movement for placing adjacent to the wrist of the wearer, at least one balance wheel (30), pivoting in bearings fixed in the frame, at least one escape mechanism (26, 28) providing support for the balance wheel, an energy source (12), clockwork finishing movements (14), connecting the energy source to the escape mechanism and motion work (42).The balance wheel turns about an axis (YY), inclined in relation to the reference planes and intersecting the same, the point of intersection (PA) of the axis (Y) with the first plane (A) being closer to the center of the movement than the point of intersection (PB) of the axis (Y) with the second plane (B).

20 Claims, 16 Drawing Sheets

WATCH MOVEMENT

TECHNICAL FIELD

The present invention relates to watch movements, more particularly of the type comprising a sprung balance. Movements of this type comprise a frame. They are inserted between first and second parallel plane surfaces. The first surface generally serves as support for the dial, while the second is defined by the upper face of the bridges or of the oscillating weight, or the upper face of parts making up a mechanism. This face is generally intended to be adjacent to the wrist of the wearer.

BACKGROUND OF THE INVENTION

The frame supports wheel assemblies generally arranged such that their axes of rotation are parallel to each other and perpendicular to said plane surfaces. These wheel assemblies, of discoid shape, are more or less superimposed, depending on their position in reference to the frame. One of them, arranged to support time indicator organs, is arranged in the vicinity of the first surface.

One also knows movements built in several sections, enveloping the wrist and making it possible to make a domed watch. The curve allowed by such a shape makes it possible to make relatively thin watches which have a particular esthetic. The movement thus realized occupies a relatively significant volume. It is unfortunately difficult to realize a sealed case able to house a movement of this type. Such movements are, for example, described in documents CH 60 360 or EP 1 394 638.

One also knows movements provided with a tourbillon whereof the cage supports a balance inclined in relation to the plane of the movement, described, for example, in documents WO 03/017009, WO 2005/043257 and EP 1 564 608. In these movements, and due to the rotation of the cage, the axis of the balance forms the envelope of a cone. Such a solution has the advantage of reducing the sensitivity to positions, but requires a substantial volume.

BRIEF DESCRIPTION OF THE INVENTION

The primary aims of the present invention are to enable the realization of a movement occupying a limited volume, able to be housed without other in a sealed case and/or to offer optimal operating conditions of the balance.

To this end, the movement according to the invention comprises a frame, limited by first and second parallel plane surfaces and defining first and second reference planes, the second plane being on the side of the movement designed to be adjacent to the wrist of the wearer, and which comprises:

- a balance having an arbor pivoting in bearings fixed in said frame,
- an escapement allowing to maintain the balance,
- an energy source,
- a going train wheel assembly generally connecting the energy source to the escapement and ensuring the reduction of the torque applied by the energy source to the first wheel assembly of said going train, and a motion work wheel assembly generally connecting the display means to correction means.

According to the invention, the balance oscillates around an axis inclined in relation to the reference planes and intersecting the latter, the point of intersection of the axis with the first plane being closer to the center of the movement than the point of intersection of this axis with the second plane. In this way, the incline of the balance frees up volume in the central part of the movement near the dial, which generally receives the wheel assembly supporting the time indicating organ.

The distribution of the components arranged in this part of the watch is difficult to achieve. Thus, by freeing up space, construction security can be increased, without the occupied volume being more significant.

Advantageously, the frame comprises an organ on which the balance and the escapement are mounted, which together form a platform escapement.

It appears that inclining all of the wheel assemblies of the going train in relation to the reference planes allows a different distribution of the components, which offers in particular new possibilities for esthetic creations.

In a piece where the energy source is formed by a barrel, it is also possible to arrange the balance and the barrel inclined in relation both to the reference planes and to each other.

When the movement is equipped with an automatic mechanism, comprising an inertial mass passing above the balance, the fact that the balance is inclined, as defined in claim 1, makes it possible to free up space in order to increase the volume of the sector of the inertial mass, thereby improving the winding conditions, especially for movements with small dimensions.

In order to reduce operating deviations as much as possible between the different positions of the watch, while also having a balance with a sufficiently large diameter for its inertial momentum to grant the movement good regulating qualities, the axis of the balance makes an angle between 15° and 30° with the reference planes.

Advantageously, in a movement also comprising a winding and setting stem, a plane passing through the axis of the balance and perpendicular to the reference planes makes an angle between 30° and 60° in relation to the axis of said stem.

The movement can comprise more than one balance, for example two balances, each of the balances oscillating around an axis inclined in relation to the reference planes and intersecting them, the points of intersection of the axes with the first plane being closer to the center of the movement than the points of intersection of the axes with the second plane.

BRIEF DESCRIPTION OF THE DRAWINGS

The invention will be better understood upon reading the following description, provided as an example and done in reference to the drawing in which:

FIGS. 12 and 13 illustrate a movement portion according to a variation of the second embodiment, seen in perspective view and outline sketch, respectively, while

DETAILED DESCRIPTION OF THE INVENTION

Figure 1:
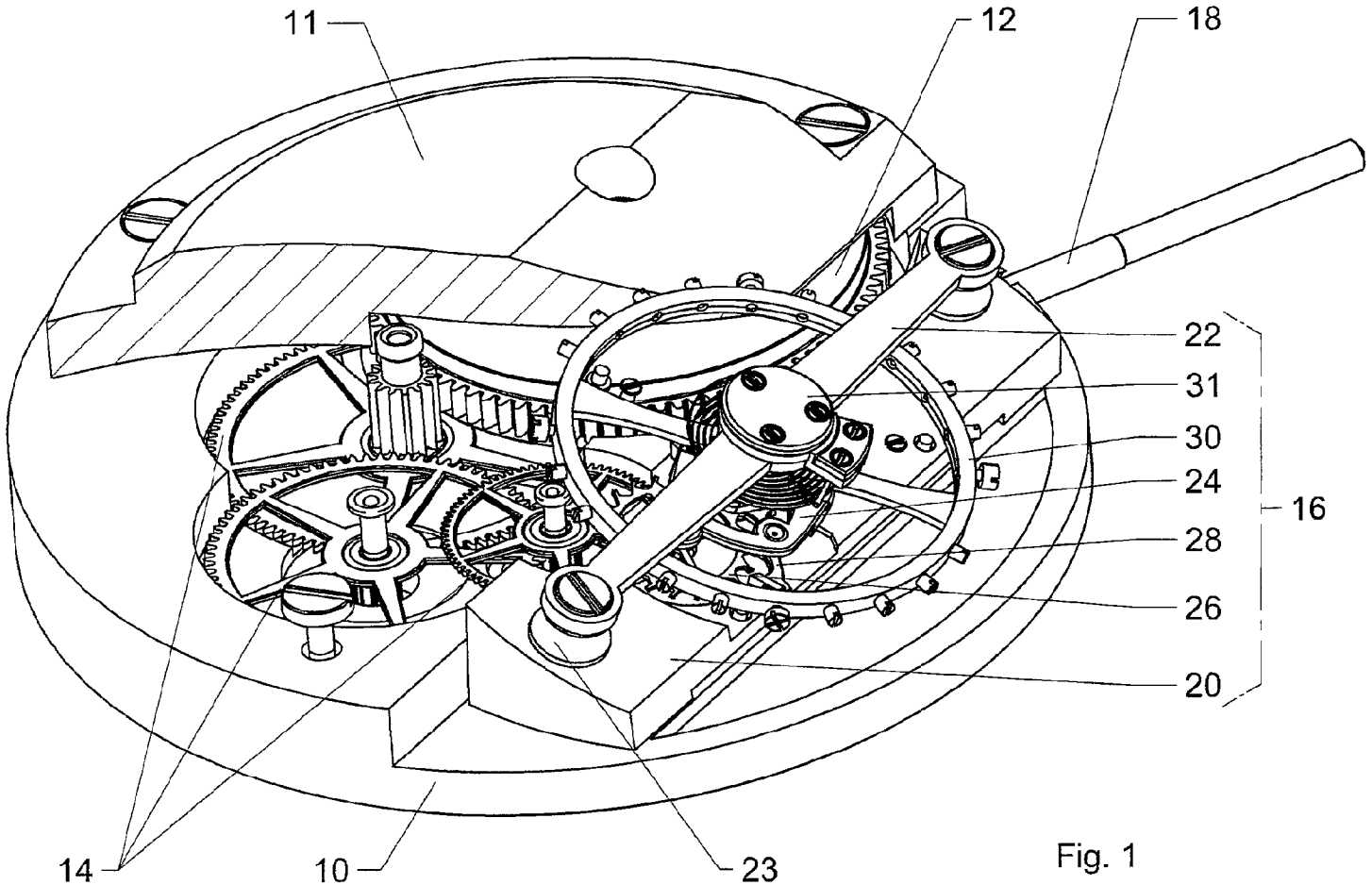
FIGS. 1 to 4 illustrate all or part of a watch movement according to a first embodiment of the invention.
Figure 2:
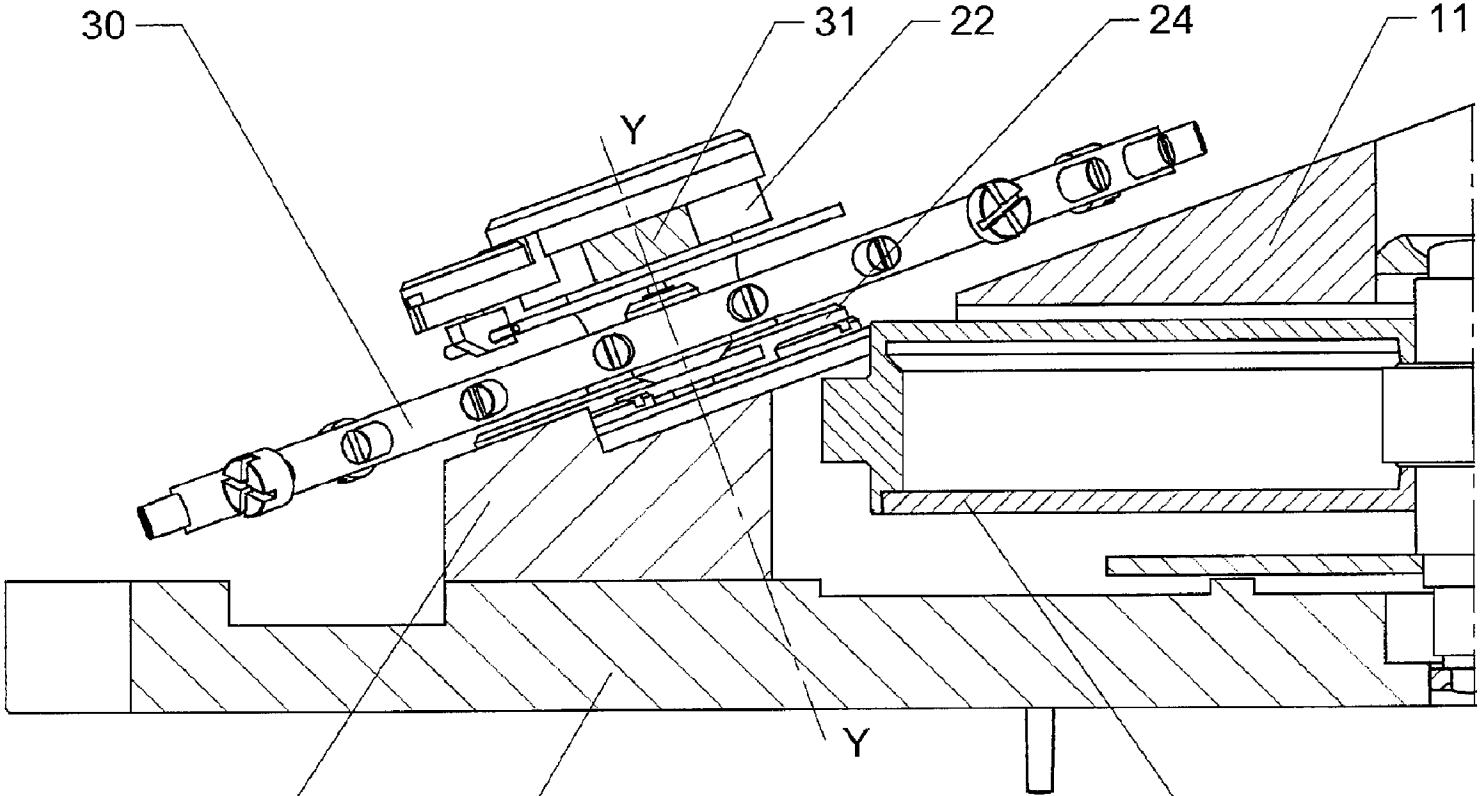
Figure 3:
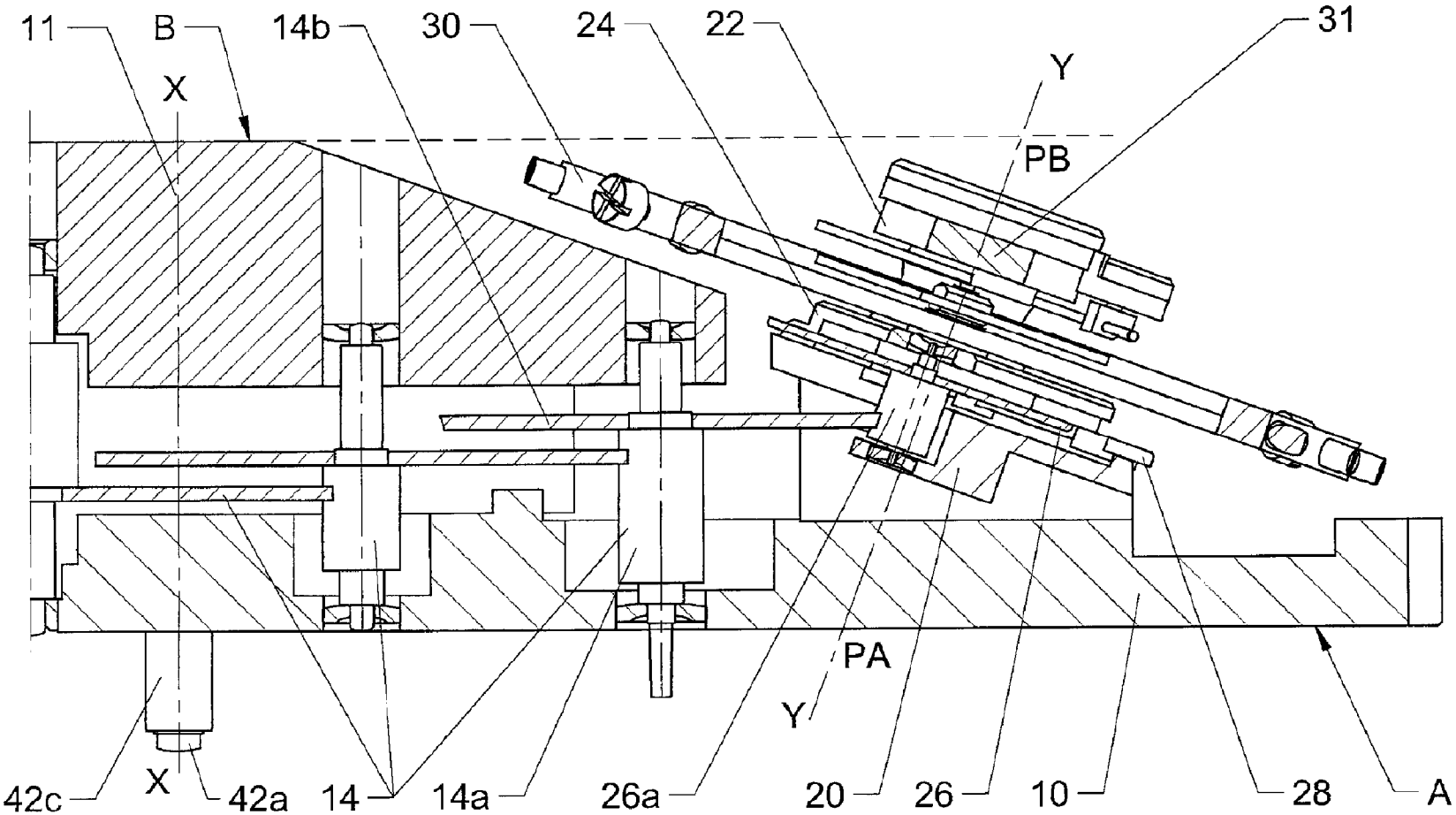

The watch movement illustrated in FIGS. 1 to 4 comprises in particular and traditionally a plate 10 and a plate bar 11, partially removed in FIG. 1 and secured on the plate 10 using screws (not referenced), a barrel 12 forming the energy source, a going train 14, a regulating organ made up of a platform escapement 16 and a winding and setting mechanism comprising in particular a setting stem 18, only component visible in these figures. The plate 10 is of a generally discoid shape and defines a central axis XX (FIG. 3). In this movement, the barrel 12 and the components of the going train 14 turn around axes parallel to the axis XX.

The platform escapement 16 comprises a base 20 and, secured on the latter using screws (not referenced), a balance-cock 22, two columns 23 inserted between the base 20 and the cock 22 (FIG. 1), and an escapement bridge 24. An escape wheel 26 and an anchor 28, together forming the escapement of the watch, are mounted pivoting between the base 20 and the escapement bridge 24. This mechanism ensures the maintenance of a sprung balance 30 mounted pivoting between the base 20 and the balance-cock 22, around an axis YY (FIG. 3), in bearings 31 secured respectively in the base 20 and the balance-cock 22, only the bearing connected to the cock 22 being visible in the drawing. These bearings are advantageously of the anti-shock type.

The plate 10, the plate bar 11, the base 20, the balance-cock 22 and the escapement bridge 24 form the main components of the frame of the movement. The outer surfaces of the plate 10 and of the plate bar 11 define parallel planes A and B (FIG. 3). The outer surface of the plate 10, defining the plate A, is designed to support a dial, while the plane B is in the part of the movement adjacent to the wrist of the wearer.

Typically, the axis YY is inclined by 15° to 30° in relation to one perpendicular to the planes A and B, the incline depending on the characteristics of the movement. The most favorable spatial conditions are obtained when a plane parallel to the plane A and going through the end of the arbor of the balance closest to the felloe is tangent to the outside thereof. In this way, the balance uses the minimum thickness. It goes without saying that other construction parameters can also be used to define this incline.

As shown in FIGS. 1 to 4, the base 20 has, according to a plane going through the axes XX and YY, a corner section, forming a rectangle triangle. The largest of the sides adjacent to the right angle bears against the plate 10. The hypotenuse defines a plane which forms a reference surface, the axes of the balance 30, anchor 28 and escape wheel 26 being perpendicular thereto. This means that the balance 30 and the components 26 and 28 of the escapement turn around axes inclined in relation to the planes A and B of the movement, the incline being equal to the angle formed by the hypotenuse and the long side of the aforementioned triangle. As shown in FIG. 3, the orientation of the balance is such that the point of intersection PA of the axis Y with the plane A is closer to the axis XX than the point of intersection PB with the plane B.

The assembly of the movement which has just been described begins by placing bearings and feet. Then, the mechanisms and the train are mounted on the plate. In parallel, the components of the platform escapement 16 are assembled and adjusted. The latter is then put into place on the plate, as the last operation. If necessary, the running of the piece can be adjusted again.

FIG. 2 shows one advantage which may be drawn from a configuration such as that of the described movement. By placing the balance 30 inclined in relation to the barrel 12, it is possible to have more space for the latter, or to reduce the thickness of the movement for a same barrel volume. Moreover, because the balance 30 is inclined in relation to the planes A and B, the gaps between the vertical positions and the horizontal positions are reduced. Indeed, when the watch is in horizontal position, meaning that the planes A and B are horizontal, the axis of the balance is inclined. Moreover, when the watch is placed in a vertical position, the axis of the balance is also inclined and not horizontal as in traditional watches. In this way, the instantaneous rates measured are closer to the usual wearing conditions. This is particularly true when the construction is such that a plane going through the axis YY of the balance and perpendicular to the planes A and B makes an angle between 30° and 60° in relation to the axis of the stem 18.

As one can see in FIG. 3, a correct connection between the going train 14, and more particularly its seconds wheel 14*a*, with the escapement pinion 26*a* of the wheel 26 is ensured thanks to the fact that the board 14*b* of the wheel 14*a* has a conical toothing.

Figure 4:
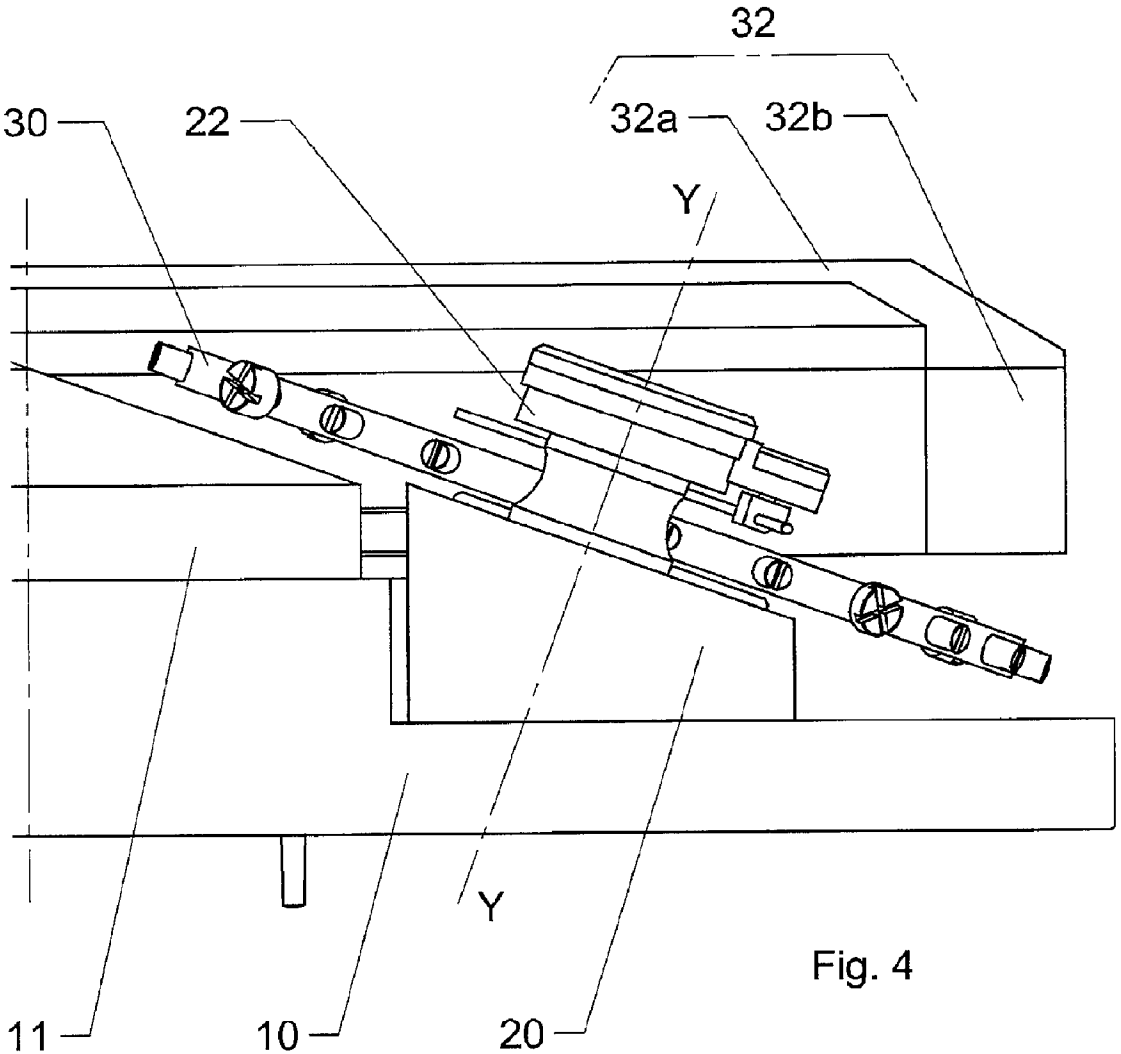
Figure 5:
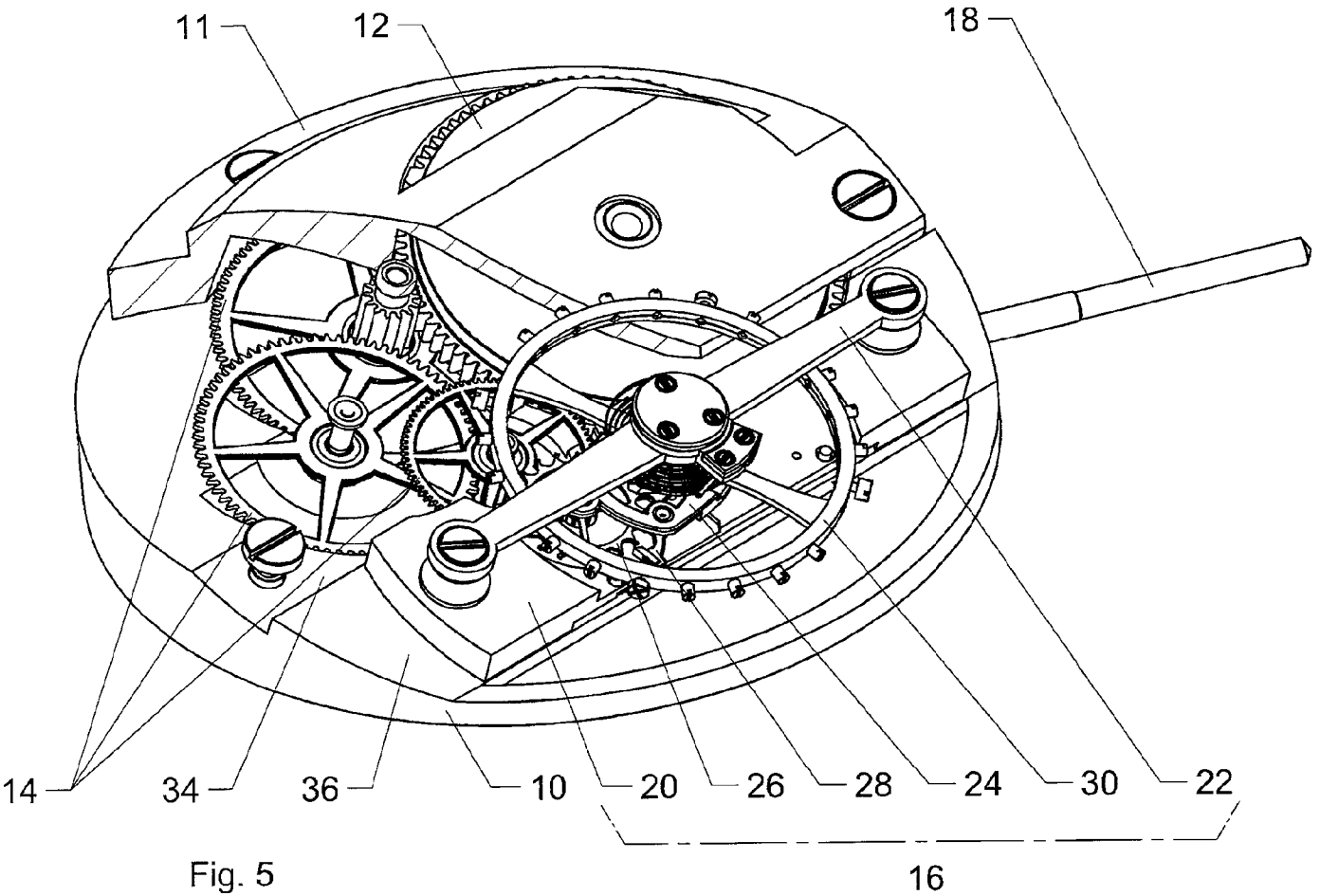
FIGS. 5 to 11 concern a second embodiment.
Figure 6:
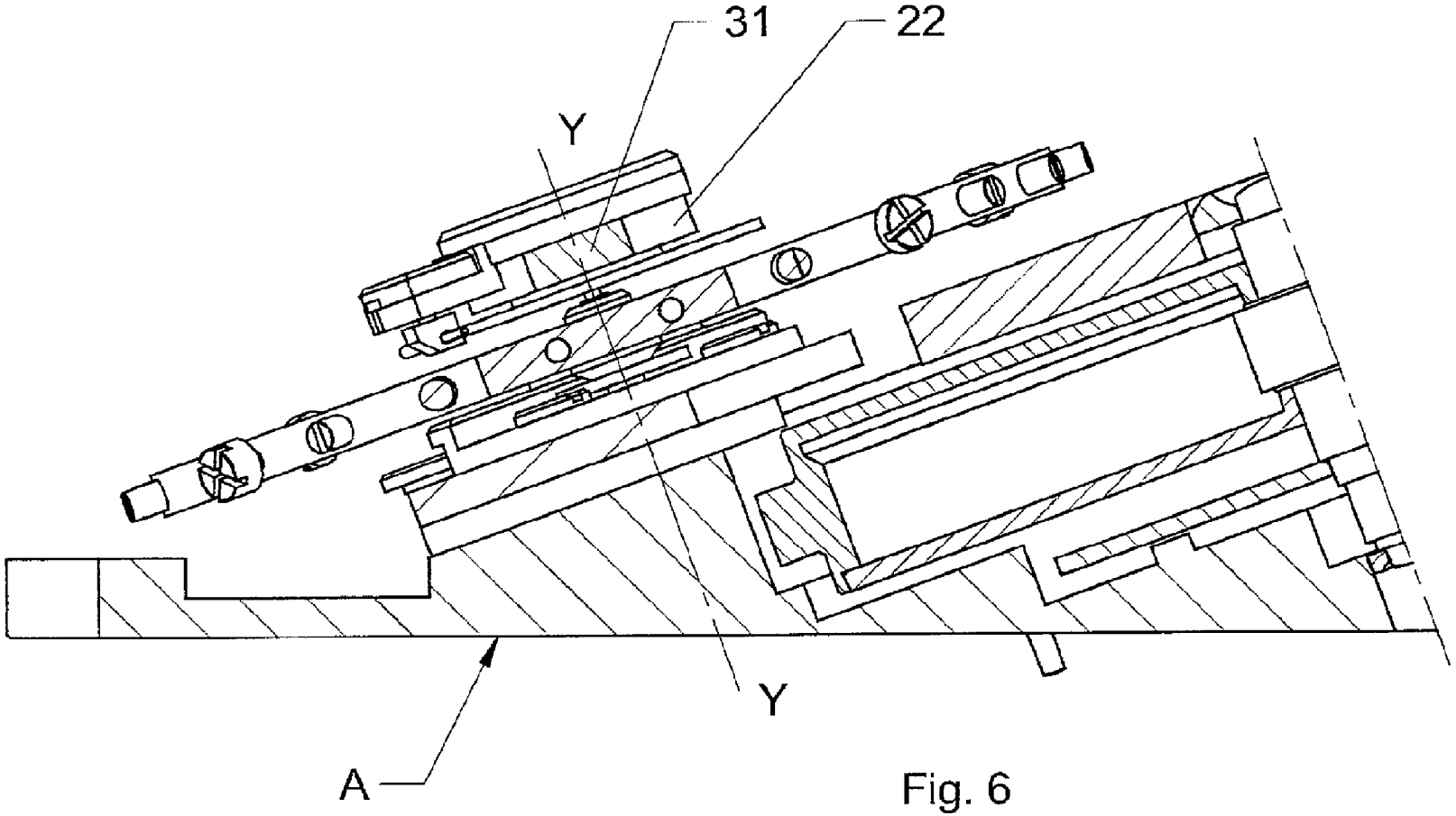
Figure 7:
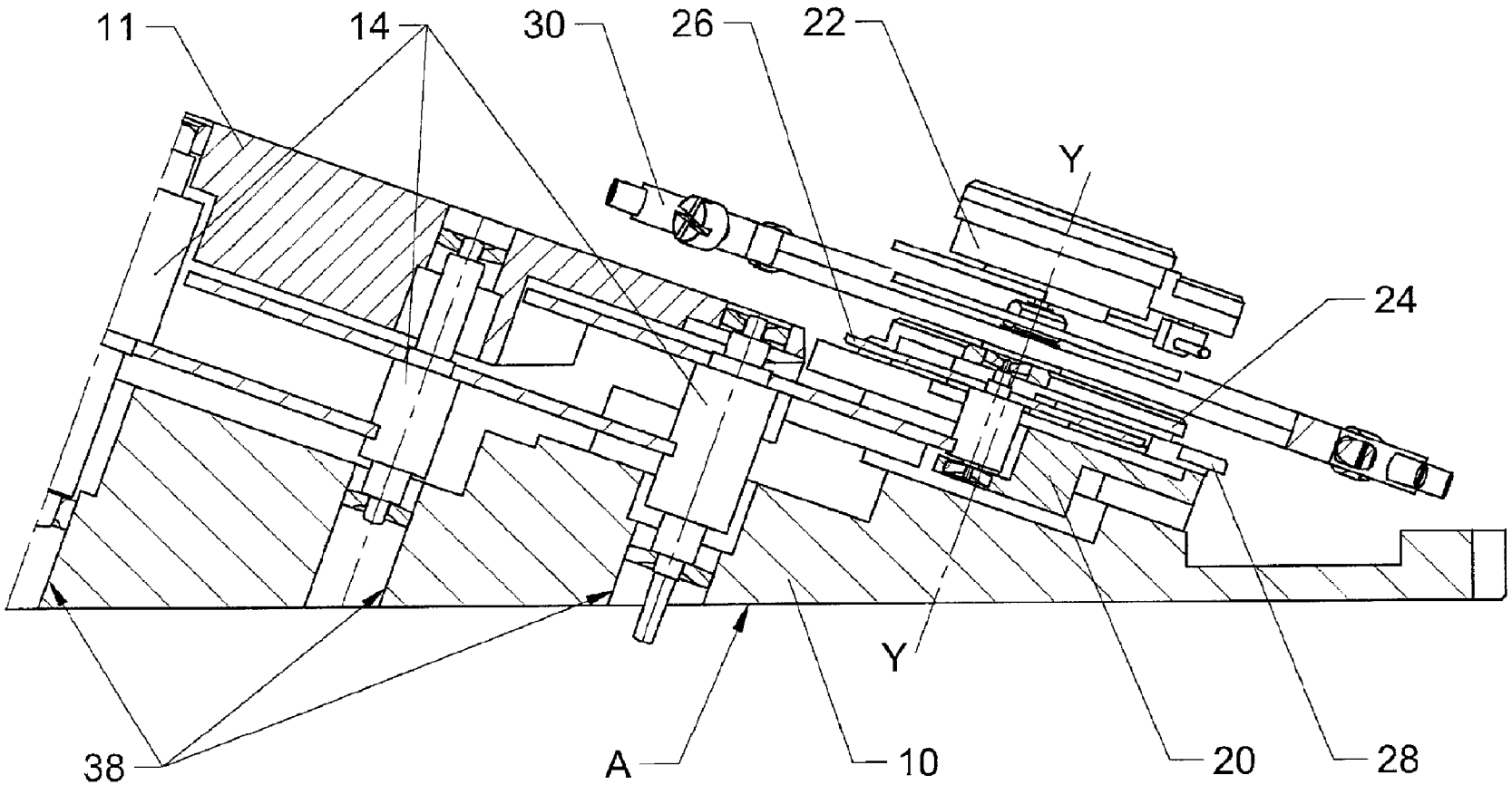
Figure 8:
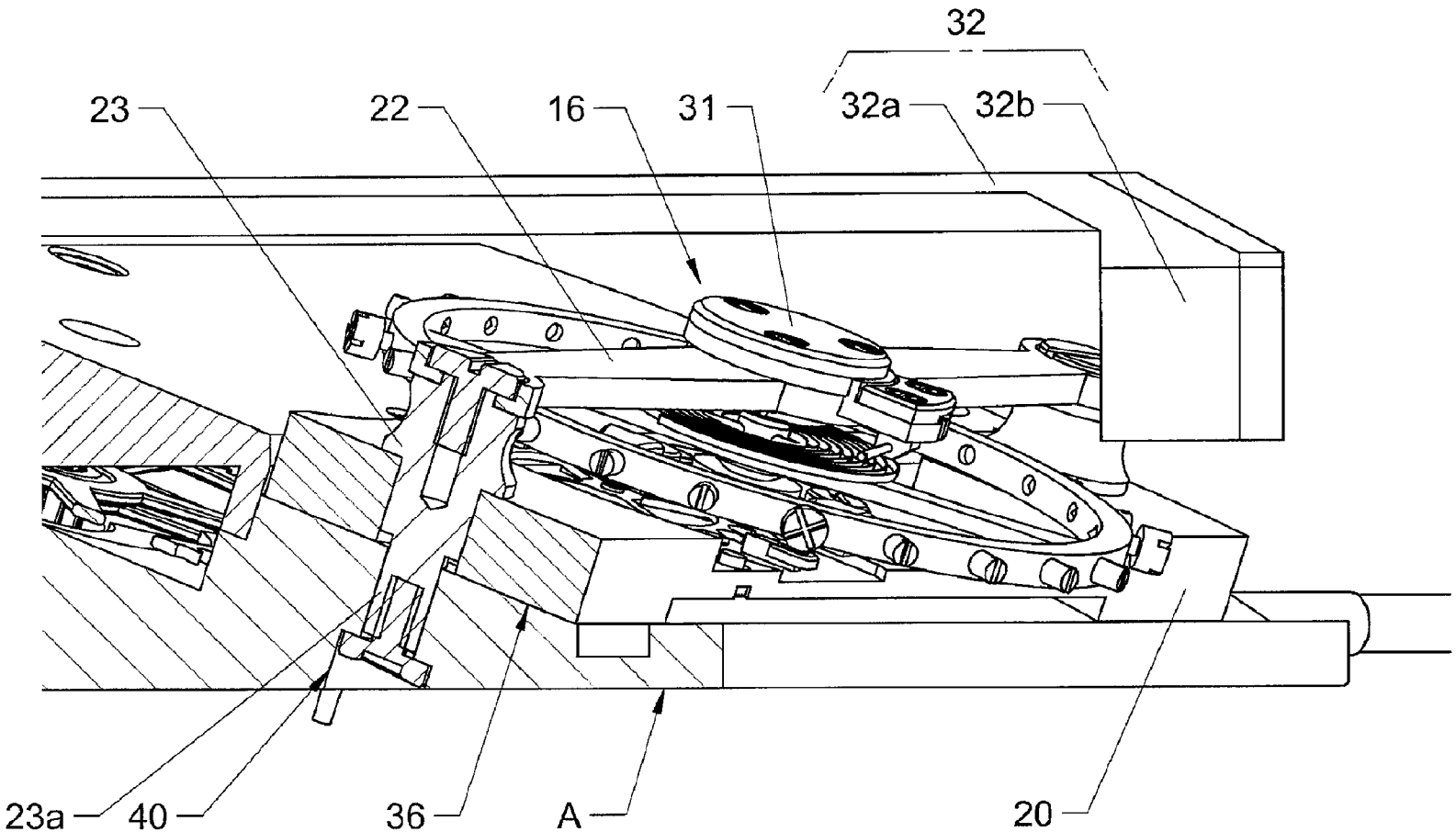
Figure 9:
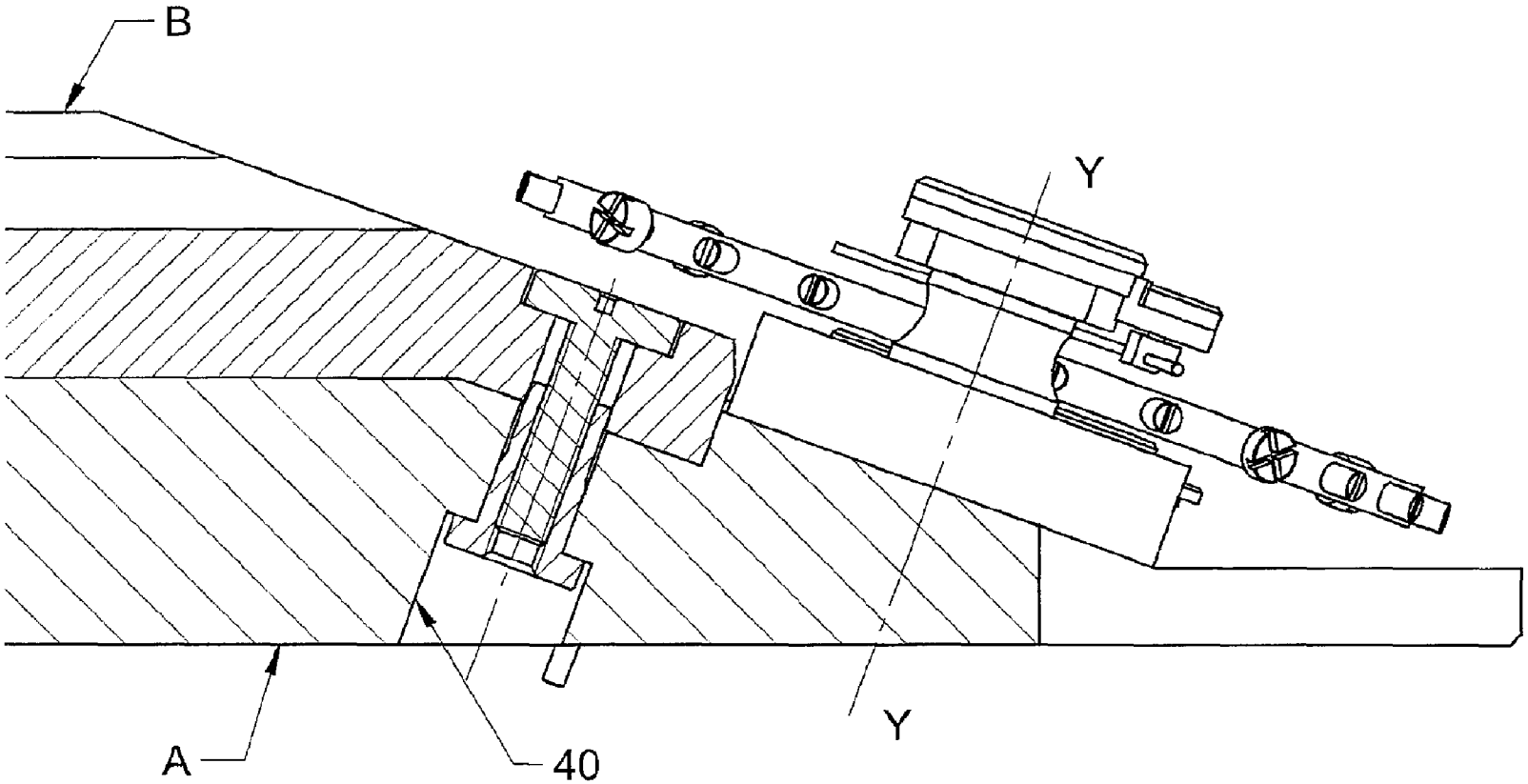
Figure 10:
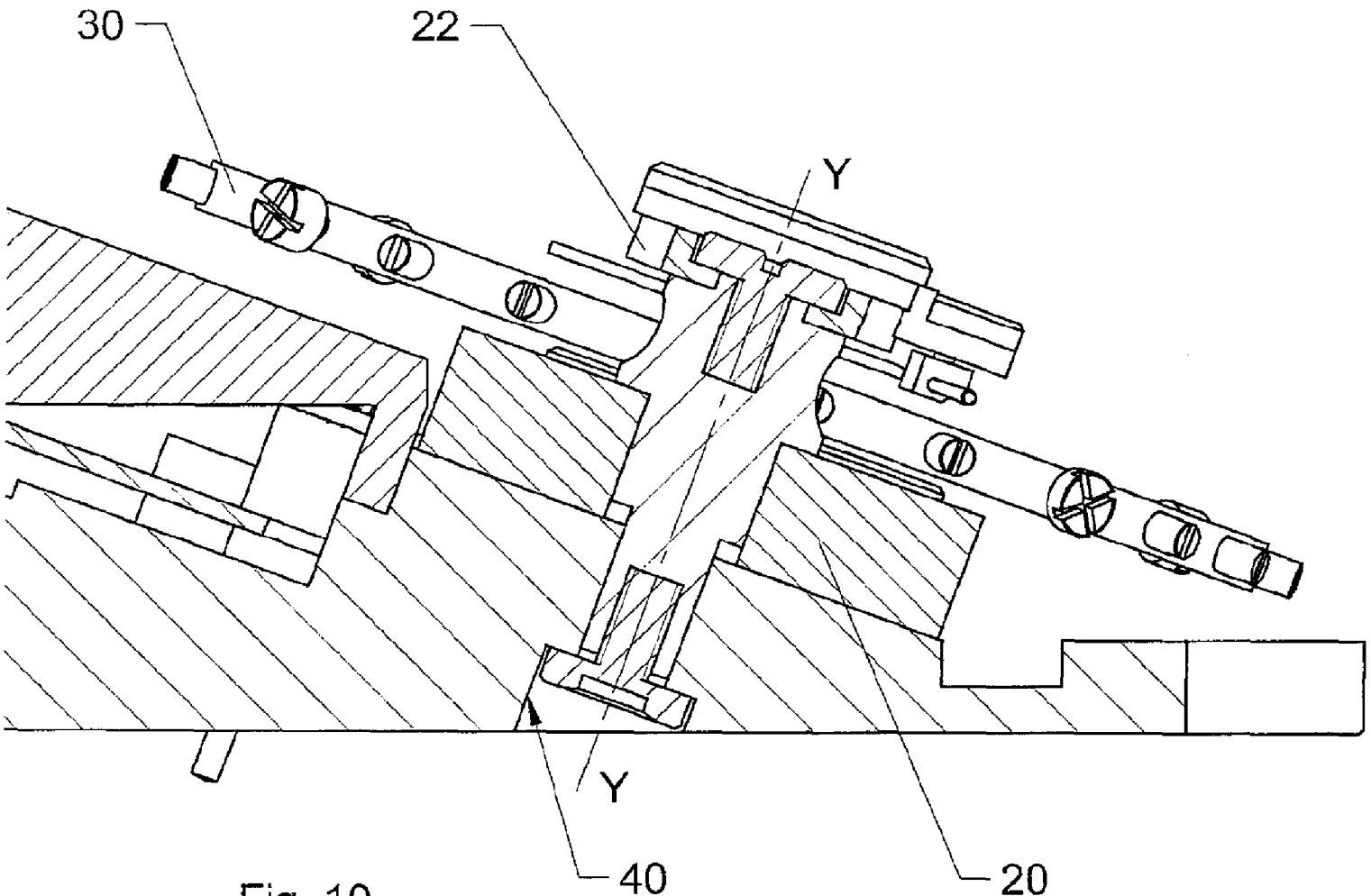

In FIG. 4, the movement illustrated in the preceding figures is completed by an automatic winding mechanism more particularly comprising a rotor 32 including a board 32*a* and an inertial mass 32*b*. Due to the incline of the balance 30, the thickness reserved for the inertial mass 32*b* can be substantially increased. In this way, even with a reduced thickness or diameter, it is possible to obtain a winding torque equivalent to those of existing movements.

FIGS. 5 to 11 illustrate a watch movement according to a second embodiment. In these figures, the same components bear the same references as those used for the first embodiment. This movement differs from that illustrated in FIGS. 1 to 4 due to the fact that the going train wheel assemblies 14 as well as the barrel 12 are parallel to the axis YY of the balance 30.

In this embodiment, the plate 10 comprises support surfaces 34 and 36 (FIG. 5) which are not perpendicular to the axis XX, as is generally the case, but rather to the axis YY. Moreover, the holes in which the bearings 38 are arranged ensure the pivoting of the going train wheel assemblies 14 and those serving to house foot screws 40 are also inclined in relation to the axis XX and are parallel to the axis YY (FIGS. 6 to 10).

The support surface 36 ensures the positioning of the platform escapement 16. As one can see more particularly in FIG. 8, the columns 23 are driven in the base 20. The cock 22 is secured on the columns 23 using screws (not referenced). The columns 23 are provided with feet 23*a* protruding from the base 20 from the side of the plate 10 and are engaged in holes 40 thereof, secured using screws.

In a variation not shown, the base of the platform escapement 16 could have been removed and the bearing of the balance secured directly in the plate 10. The balance-cock 22 would then also be secured directly on the plate 10.

Figure 11:
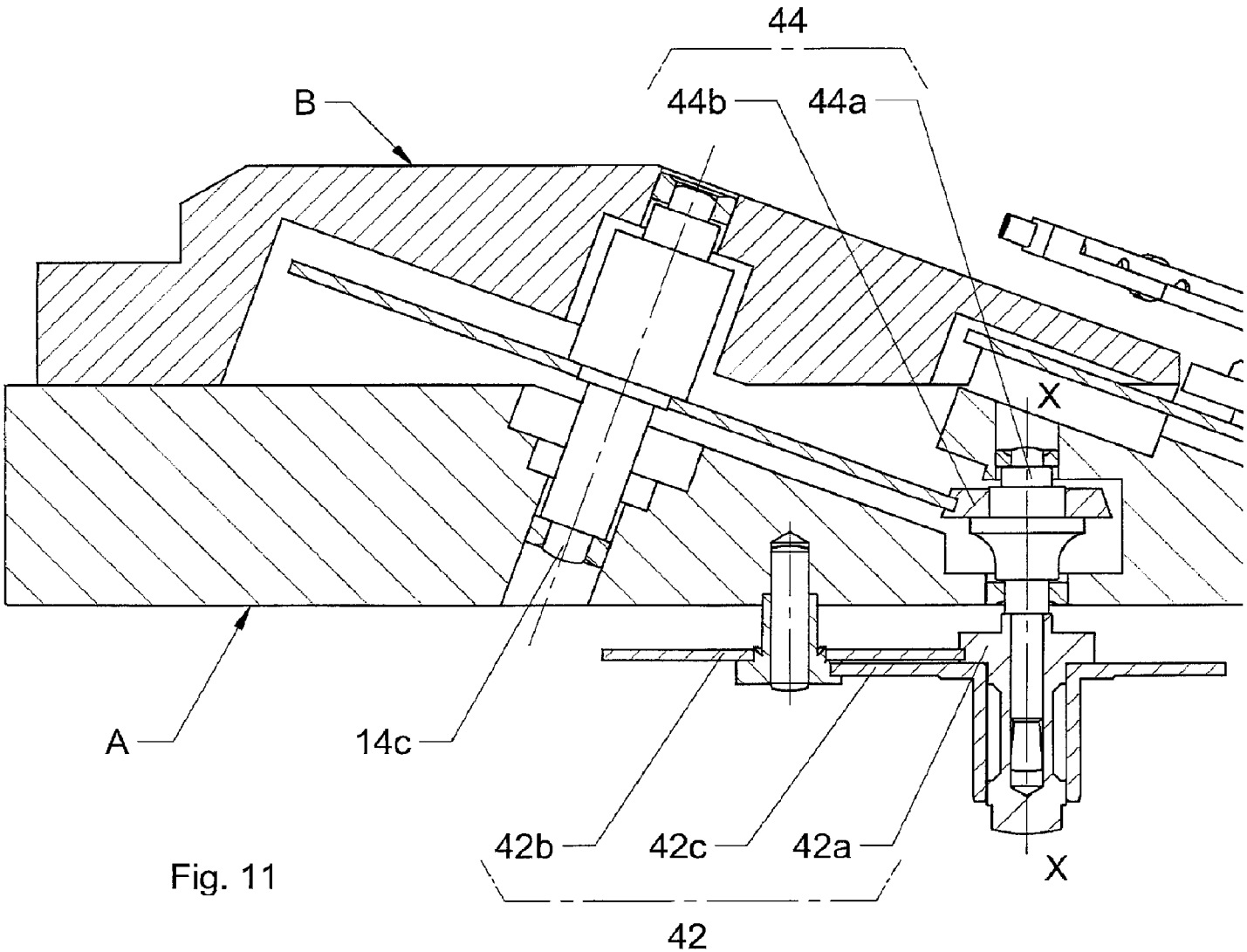

As shown by FIG. 11, the display is done using wheel assemblies whereof the axis is parallel to the plane A. To this end, the movement supports a minute train 42 comprising a cannon-pinion 42*a*, a minute wheel 42*b* and an hour wheel 42*c*, the cannon-pinion 42*a* and the hour wheel 42*c* turning around the axis XX.

A pinion 44 is mounted pivoting in the plate 10. It comprises an arbor 44*a* and a conical toothing 44*b*. The cannon-pinion 42*a* is frictionally fastened on the arbor 44*a*.

The going train 14 comprises a wheel 14*c* driven by the barrel 12 and turning at a speed slower than one revolution per hour. It drives the pinion 44*a* which must perform one revolution per hour and which causes the cannon-pinion 42*a* to turn with it. The latter part drives the minute wheel 42*b*, which is engaged with the hour wheel 42*c*.

Thus, thanks to the conical toothing of the pinion 44, it is possible to realize a movement in which the display is done in planes parallel to the plane A, while having oriented the wheel assemblies of the going train and the time base along axes parallel to each other but inclined in relation to the planes A and B.

Figure 12:
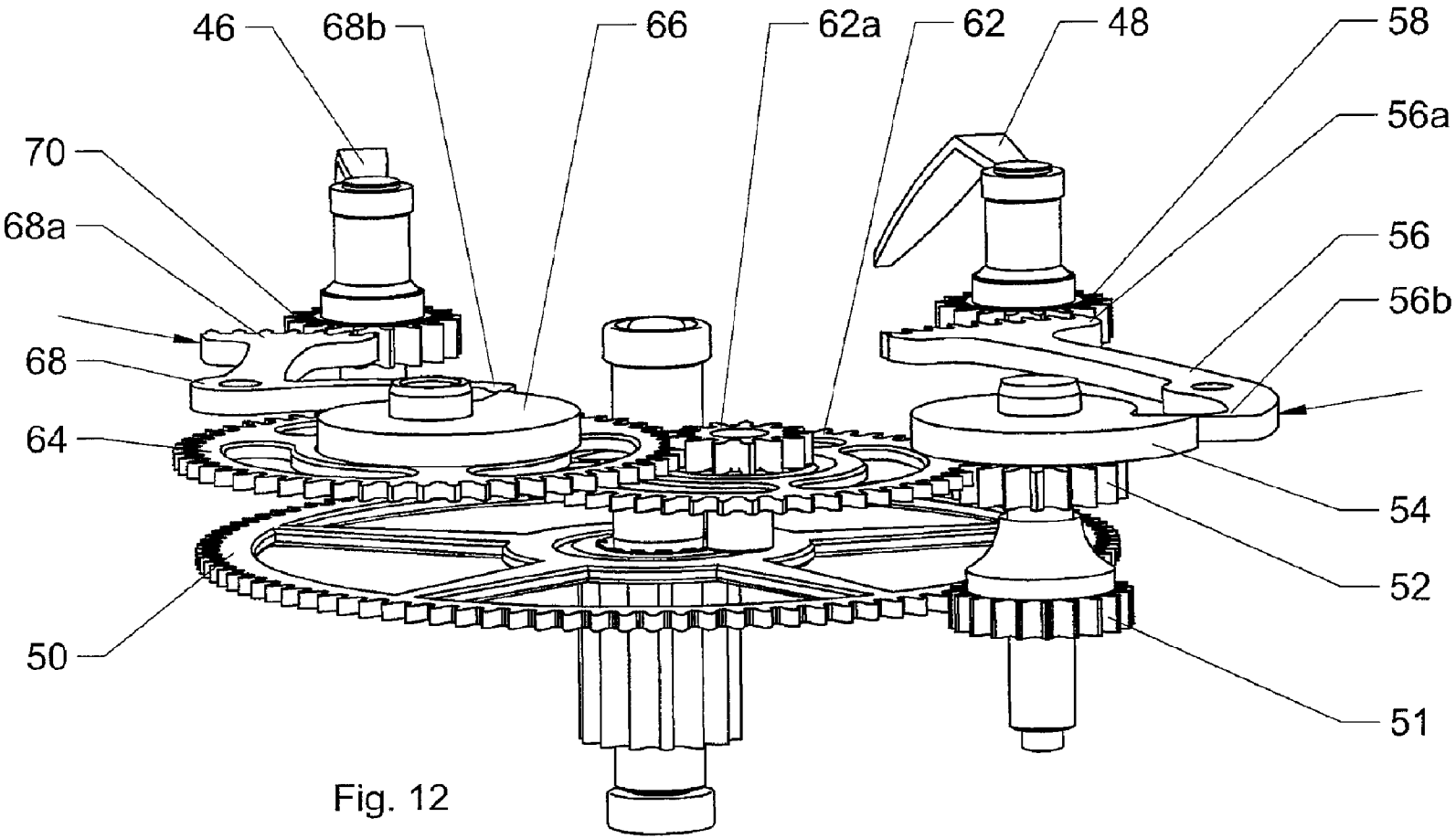
Figure 13:
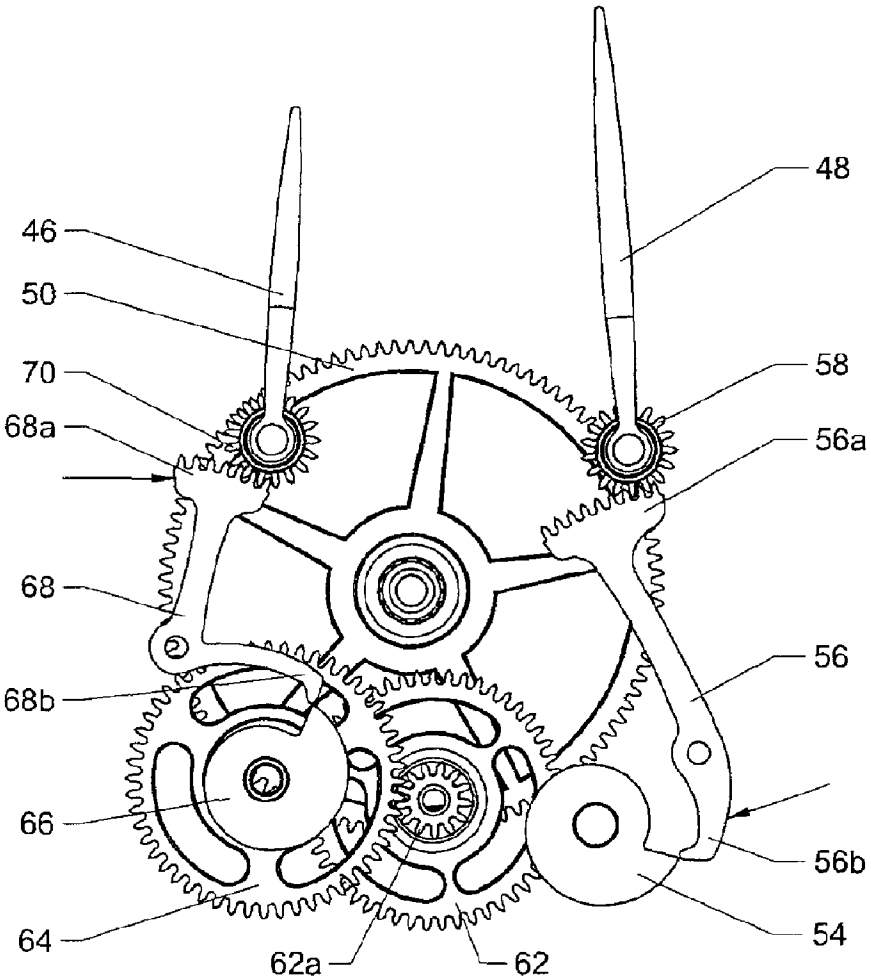
Figure 15:
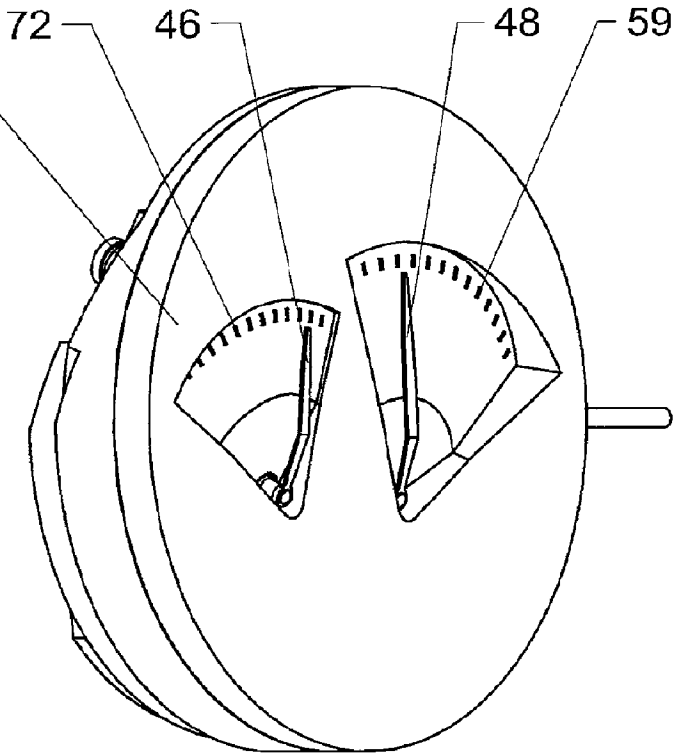
FIGS. 14 and 15 illustrate a watch provided with a movement of this type, seen from two different angles.
Figure 14:
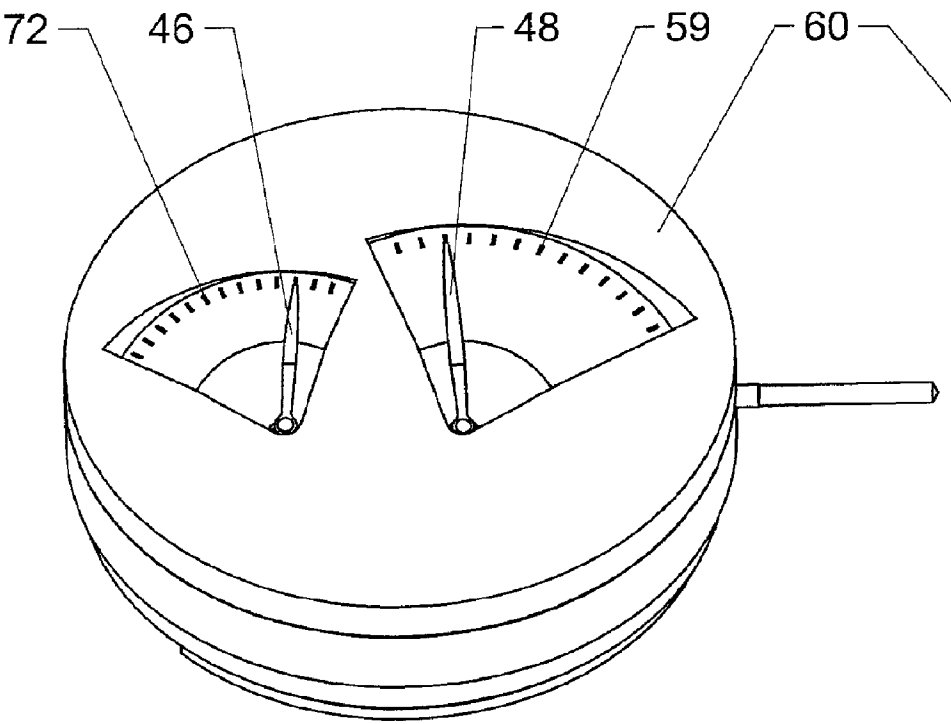

FIGS. 12 and 13 show part of the wheel assemblies of a movement, variation of the embodiment previously described and bearing hands 46 and 48 designed to display the hours and minutes, respectively. These wheel assemblies are arranged on the frame of the watch, which does not appear in these figures, to avoid overloading the drawing. They are arranged parallel to the axis YY. More precisely, the movement supports a wheel 50 driven by the barrel and performing one revolution in several hours. It meshes with a pinion 51, mounted pivoting on the frame, and which supports, frictionally mounted, a cannon-pinion 52, which is provided with a cam 54 of the spiral type. A lever 56, provided with a toothed sector 56*a* at one end and a finger 56*b* at the other end, rests by its finger 56*b* against the cam 54, under the effect of a spring diagrammatically illustrated by an arrow. A pinion 58 is engaged with the toothed sector 56*a*. It supports the hand 48. The cam 54 turns with the cannon-pinion 52 and causes the angular movement of the lever 56, which causes the hand 48 to turn, which moves opposite a graduated scale 59 supported by a dial 60 (FIGS. 14 and 15). The gear ratio between the wheel 50 and the pinion 52 is chosen such that the latter part performs one revolution in one hour. As a result, the hand 48 sweeps the graduated scale 59 in one hour.

Once the cam 54 has performed one revolution, the lever 56 falls back and the hand 48 jumps abruptly while crossing the graduated scale 59 in the counterclockwise direction.

A motion work wheel assembly 62 meshes with the cannon-pinion 52. It drives, via its pinion 62*a*, an hour wheel 64 supporting a cam 66 of the spiral type. A lever 68, provided with a toothed sector 68*a* at one end and a finger 68*b* at the other end, is kept resting against the cam 66 by a spring diagrammatically illustrated by an arrow. A pinion 70 meshes with the toothed sector 68*a*. It supports the hour hand 46, which moves opposite a graduated scale 72 supported by the dial 60.

Due to the reduction of the motion work wheel assembly, the hour wheel performs one revolution in twelve hours. The result is that the cam causes the sweeping of the graduated scale at a rate of one revolution in twelve hours, after which the hand 46 returns backward when the lever 68 arrives at the end of travel and falls.

As shown more particularly in FIG. 15, the hands 46 and 48 have a fold. In this way, they sweep a cone sector allowing an original display esthetic.

Figure 16:
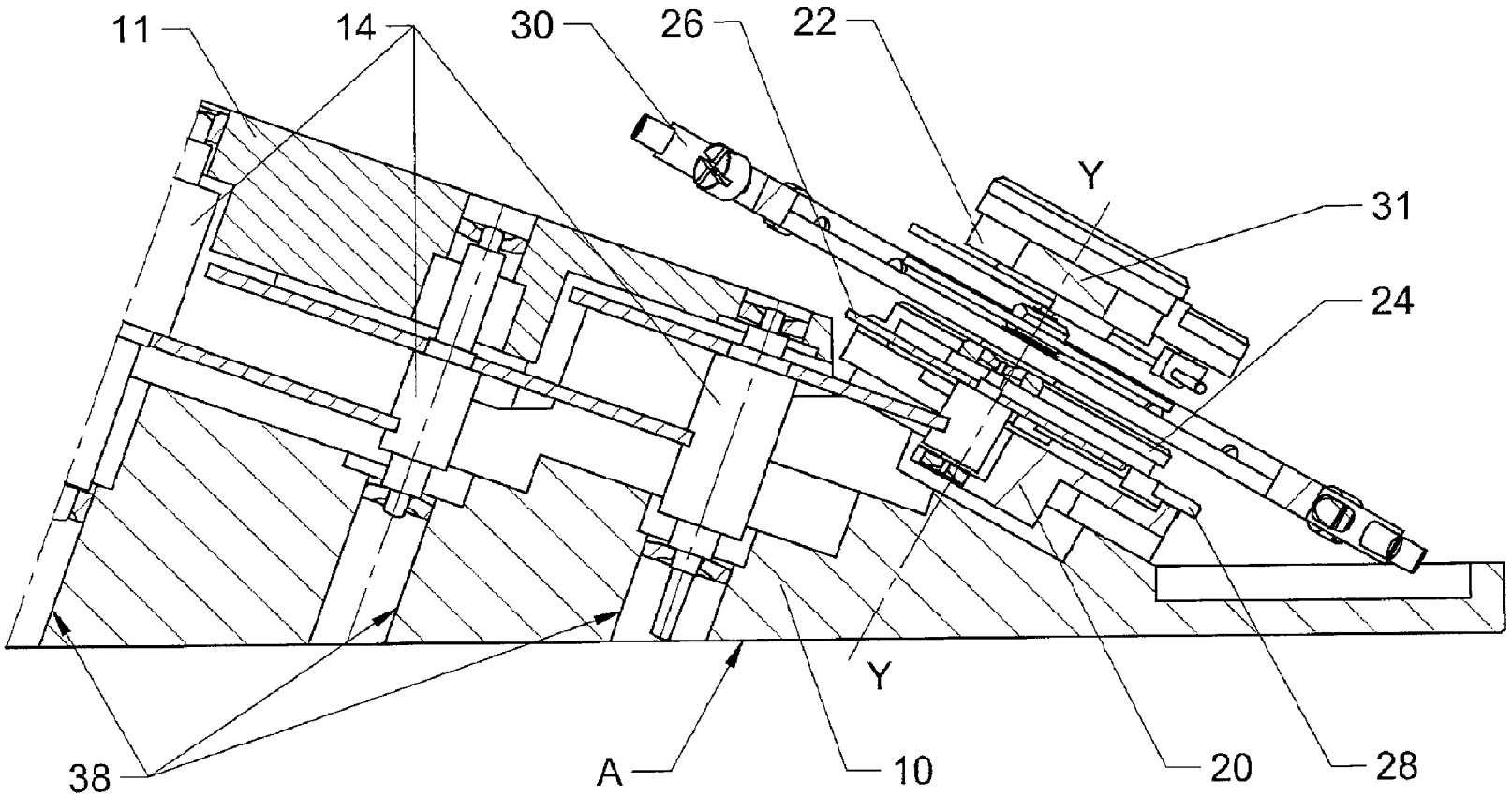
FIG. 16 refers to another variation of the second embodiment.

In the variation illustrated in FIG. 16, we find the wheel assemblies of the going train 14 and the barrel 12 inclined in relation to the planes A and B. In this variation, however, the axis YY of the balance is not parallel to the axes of these trains. Its incline is greater. A solution of this type makes it possible to have a greatly inclined balance, while connecting the going train 14 to the escape wheel 26 without having to have conical meshing, the difference in incline being sufficiently small for the working conditions of straight meshing not being affected.

Figure 17:
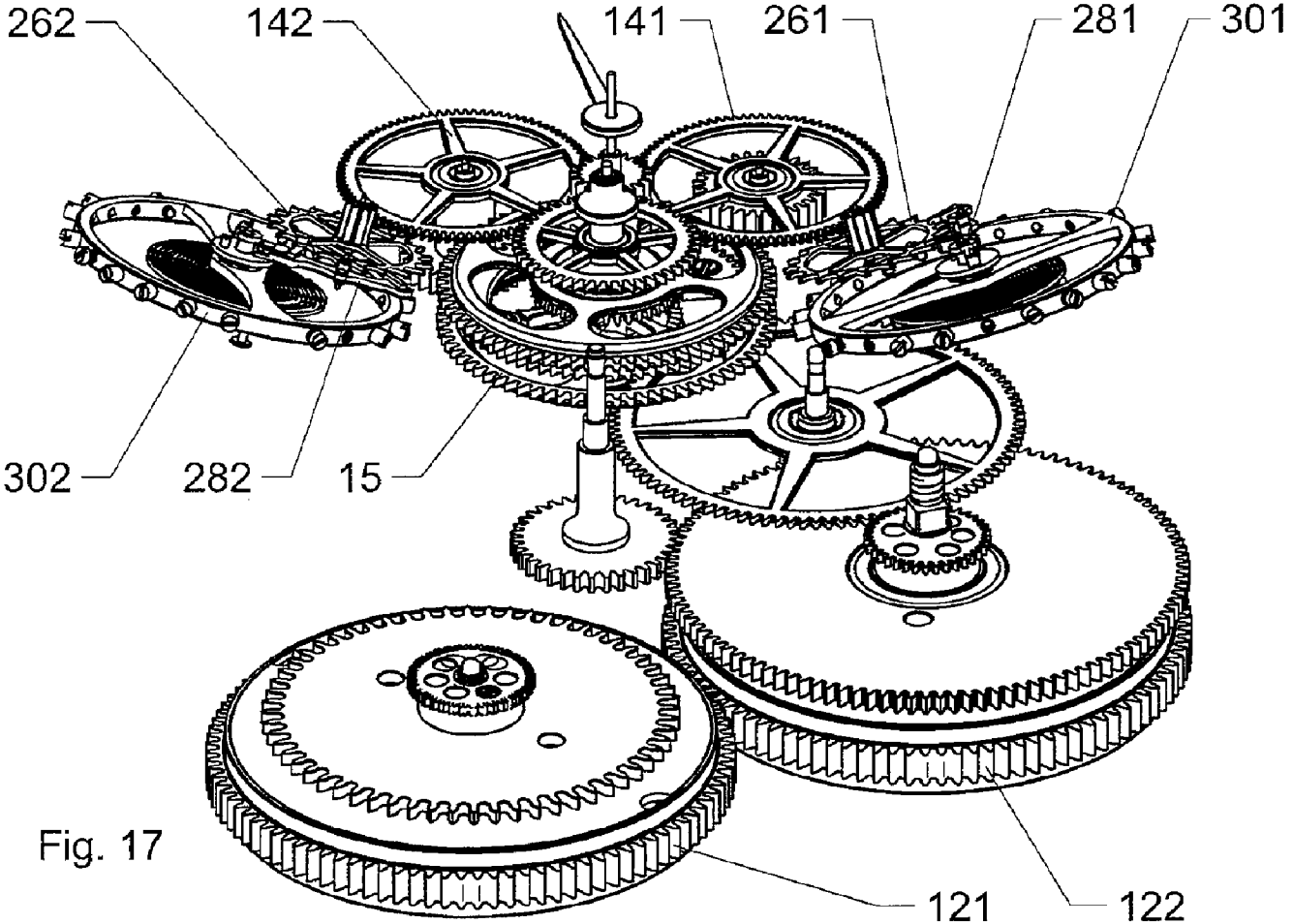
FIG. 17 illustrates a variation of the first embodiment.

The movement illustrated in FIG. 17 is shown without its frame. One therefore only sees the wheel assemblies, and more particularly two barrels 121 and 122, connected in series, a going train 14 provided with a differential gear 15 which drives two second wheels 141 and 142, which drive an escapement comprising a wheel 261 and 262, and a anchor 281 and 282, respectively, which cause balances 301 and 302 to oscillate. This movement also comprises a motion work wheel assembly diagrammatically shown in 42 and comprising a cannon-pinion 42*a* designed to support a minute hand, not shown.

In this movement, the two balances 301 and 302 are inclined in relation to the axes of the wheel assemblies of the going train in particular. The incline is such that, if one defines two reference planes arranged on either side of the movement, the points of intersection of the axes of the balances 301 and 302 intersect the reference plane on the side of the movement designed to be adjacent to the wrist of the wearer which are further from the center of the movement than the points of intersection with the other plane. In one variation which was not shown, only one of the balances may be inclined.

The frame equipping a movement of this type may be quite similar to that of the movement described in reference to FIGS. 1 to 4. The integration of two balances into the second embodiment does not pose a particular problem for one skilled in the art. Such a solution is applicable without other.

Such a configuration also makes it possible to reduce the variation of the operation in the different positions of the movement, the two balances never being in the horizontal position simultaneously.

The movement according to the invention can be the object of many other variations without going beyond the scope of the invention. Thus, the energy source could, of course, comprise several barrels, connected to each other in series or in parallel. As explained above, the movement can comprise one or two balances, or even more. These balances can be arranged side by side or overlapping in whole or in part.

Thus, thanks to the particular characteristics presented by the different variations of the movement according to the invention, it is possible to realize a watch offering both particularly interesting technical characteristics, while also allowing original esthetic developments.

The invention claimed is:

1. A watch movement comprising a frame, limited by first and second parallel plane surfaces and defining first and second reference planes, the second plane being on the side of the movement designed to be adjacent to the wrist of the wearer, and which comprises:

at least one balance, said balance having an arbor which pivots in bearings secured in said frame, at least one escapement allowing to maintain the balance, an energy source, a going train wheel assembly connected the energy source to the escapement and a motion work wheel assembly, wherein said balance oscillates around an axis inclined in relation to said reference planes and intersecting them, the point of intersection of said axis with the first plane being closer to the center of the movement than the point of intersection of said axis with the second plane.

2. The movement according to claim 1, wherein the frame comprises an organ on which the balance and the escapement are mounted, which together form a platform escapement.

3. The movement according to claim 1, wherein the wheel assemblies of the going train are also inclined in relation to the reference planes.

4. The movement according to claim 1, wherein said energy source is made up of a barrel and wherein said balance and said barrel are inclined in relation to the reference planes and in relation to each other.

5. The movement according to claim 1, further comprising an automatic winding mechanism comprising a weight passing above the balance.

6. The movement according to claim 1, wherein the axis of the balance forms an angle between 15° and 30° with said planes.

7. The movement according to claim 6, also comprising a winding and setting stem, wherein a plane passing through the axis of the balance and perpendicular to said surfaces forms an angle between 30° and 60° in relation to the axis of said stem.

8. The movement according to claim 1, wherein the wheel assemblies of the going train are perpendicular to the reference planes.

9. The movement according to claim 1, comprising two balances, each of the balances oscillating around an axis inclined in relation to said reference planes and intersecting them, the points of intersection of said axes with the first plane being closer to the center of the movement that the points of intersection of said axes (YY) with the second plane (B).

10. The movement according to claim 9, wherein said going train comprises a differential gear.

11. The movement according to claim 1, comprising two balances, each of the balances oscillating around an axis inclined in relation to said reference planes and intersecting them, the points of intersection of said axes with the first plane being closer to the center of the movement that the points of intersection of said axes (YY) with the second plane (B).

12. The movement according to claim 11, wherein said going train comprises a differential gear.

13. A watch movement, comprising:

a movement frame, limited by first and second parallel plane surfaces and defining first and second reference planes, the second plane being on a side of the movement designed to be adjacent to a wrist of a wearer;

a balance mounted directly on the frame, the balance not being mounted on a tourbillon, said balance comprising an arbor which pivots in bearings secured in said frame;

at least one escapement allowing to maintain the balance;

an energy source; and a going train wheel assembly connected the energy source to the escapement and a motion work wheel assembly, wherein said balance oscillates around an axis inclined in relation to said reference planes and intersecting them, the point of intersection of said axis with the first plane being closer to the center of the movement than the point of intersection of said axis with the second plane.

14. The movement according to claim 13, wherein the frame comprises an organ on which the balance and the escapement are mounted, which together form a platform escapement.

15. The movement according to claim 13, wherein the wheel assemblies of the going train are also inclined in relation to the reference planes.

16. The movement according to claim 13, wherein, said energy source comprises a barrel, and said balance and said barrel are inclined in relation to the reference planes and in relation to each other.

17. The movement according to claim 13, further comprising an automatic winding mechanism comprising a weight passing above the balance.

18. The movement according to claim 13, wherein the axis of the balance forms an angle between 15° and 30° with said planes.

19. The movement according to claim 18, further comprising:

a winding and setting stem, wherein a plane passing through the axis of the balance and perpendicular to said surfaces forms an angle between 30° and 60° in relation to the axis of said stem.

20. The movement according to claim 13, wherein the wheel assemblies of the going train are perpendicular to the reference planes.

* * * * *